US010399096B2

(12) United States Patent
Yamauchi

(10) Patent No.: US 10,399,096 B2
(45) Date of Patent: Sep. 3, 2019

(54) ROTARY ATOMIZING HEAD TYPE COATING MACHINE

(71) Applicant: ABB SCHWEIZ AG, Baden (CH)

(72) Inventor: Kuniharu Yamauchi, Nagakute (JP)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 15/318,569

(22) PCT Filed: Mar. 2, 2016

(86) PCT No.: PCT/JP2016/056459

§ 371 (c)(1),
(2) Date: Dec. 13, 2016

(87) PCT Pub. No.: WO2016/163178

PCT Pub. Date: Oct. 13, 2016

(65) Prior Publication Data

US 2017/0128969 A1 May 11, 2017

(30) Foreign Application Priority Data

Apr. 8, 2015 (JP) ..... 2015-079178

(51) Int. Cl.
*B05B 3/10* (2006.01)
*B05B 5/04* (2006.01)
(Continued)

(52) U.S. Cl.
CPC ..... *B05B 3/1014* (2013.01); *B05B 3/10* (2013.01); *B05B 5/04* (2013.01); *B05B 5/0407* (2013.01);
(Continued)

(58) Field of Classification Search
CPC ..... B05B 15/025; B05B 15/50; B05B 15/55; B05B 3/10; B05B 5/08; B05B 5/04
(Continued)

(56) References Cited

U.S. PATENT DOCUMENTS 5,707,009 A * 1/1998 Schneider ..... B05B 3/1014 239/112
5,894,993 A 4/1999 Takayama et al.
(Continued)

FOREIGN PATENT DOCUMENTS

JP 10-156222 A 6/1998
JP 10-156224 A 6/1998
(Continued)

OTHER PUBLICATIONS

International Search Report dated May 31, 2016 in PCT/JP16/056459 Filed Mar. 2, 2016.

*Primary Examiner* — Alexander M Valvis
*Assistant Examiner* — Qingzhang Zhou
(74) *Attorney, Agent, or Firm* — Oblon, McClelland, Maier & Neustadt, L.L.P.

(57) ABSTRACT

A rotary atomizing head includes an outer peripheral surface washing passage open onto an atomizing head outer peripheral surface for causing wash fluid supplied from a feed tube to flow out into an annular clearance between the rotary atomizing head and a shaping air ring. An outflow opening of an outflow passage constituting the outer peripheral surface washing passage is provided in a position closer to the backside into the annular clearance by a length dimension than a front end surface of a front ring section constituting the shaping air ring. Further, the outflow opening opens to the annular clearance in an angle that is an acute angle to the atomizing head outer peripheral surface.

6 Claims, 7 Drawing Sheets

(51) Int. Cl.

| | |
|---|---|
| ***B05B 5/08*** | (2006.01) |
| ***B05B 15/55*** | (2018.01) |
| *B05B 5/043* | (2006.01) |

(52) U.S. Cl.
CPC ..... *B05B 5/0426* (2013.01); *B05B 5/08* (2013.01); *B05B 15/55* (2018.02); *B05B 5/043* (2013.01); *B05B 5/0415* (2013.01)

(58) Field of Classification Search
USPC ..... 239/112, 113, 223, 224
See application file for complete search history.

(56) References Cited

U.S. PATENT DOCUMENTS

| | | | | |
|---|---|---|---|---|
| 6,050,499 | A | 4/2000 | Takayama et al. | |
| 6,557,781 | B2 * | 5/2003 | Kon | B05B 3/1064 239/104 |
| 7,861,945 | B2 * | 1/2011 | Yasuda | B05B 3/1014 239/112 |
| 2003/0010841 | A1 * | 1/2003 | Kon | B05B 3/1064 239/224 |
| 2008/0277496 | A1 | 11/2008 | Yasuda et al. | |
| 2013/0153681 | A1 * | 6/2013 | Mitsui | B05B 3/1014 239/225.1 |

FOREIGN PATENT DOCUMENTS

| | | | |
|---|---|---|---|
| JP | 2010-42360 | A | 2/2010 |
| WO | 98/14278 | A1 | 4/1998 |
| WO | 98/24554 | A1 | 6/1998 |
| WO | 2007/083677 | A1 | 7/2007 |

* cited by examiner

ROTARY ATOMIZING HEAD TYPE COATING MACHINE

TECHNICAL FIELD

The present invention relates to a rotary atomizing head type coating machine that sprays paint particles toward an object to be coated from a rotary atomizing head, for example.

BACKGROUND ART

In general, in a case of coating vehicle bodies of automobiles, articles of furniture, electrical appliances, and the like with paint, a rotary atomizing head type coating machine that is excellent in a coating efficiency and coating finish of paint is used. The rotary atomizing head type coating machine is provided with an air motor that uses compressed air as a power source, a hollow rotational shaft that is rotatably supported by the air motor and a tip end of which projects to a front side from the air motor, a feed tube that extends to the tip end of the rotational shaft through in the rotational shaft to supply paint or wash fluid, a rotary atomizing head a base end side of which is formed of a cylindrical section mounted to the tip end of the rotational shaft and a portion closer to a front side than the cylindrical section of which is formed of a cup section enlarged in a cup shape to spray paint from a tip end of the cup section, a shaping air ring that is arranged on an outer peripheral side of the rotary atomizing head, has a ring inner peripheral surface facing an atomizing head outer peripheral surface of the rotary atomizing head with a clearance, and has many shaping air spurting holes on a front end surface to spurt shaping air, and assist air spurting holes that are provided to open to the ring inner peripheral surface of the shaping air ring and spurts assist air into an annular clearance defined between the ring inner peripheral surface and the atomizing head outer peripheral surface of the rotary atomizing head.

Here, in the rotary atomizing head type coating machine, a large part of paint particles in the paint particles sprayed from the rotary atomizing head fly toward the object to be coated by the shaping air spurted from each of the shaping air spurting holes in the shaping air ring. However, a part of the paint particles sprayed from the rotary atomizing head flows around the rotary atomizing head and enters into the backside thereof, and the paint particles having entered into the back side adhere to the atomizing head outer peripheral surface.

Therefore, the rotary atomizing head in the conventional technology is provided with a solvent passage (wash fluid passage) for guiding the wash fluid onto the atomizing head outer peripheral surface from the cup-shaped inner peripheral surface. At the washing work, a part of the wash fluid ejected onto the cup-shaped inner peripheral surface from the feed tube is guided through the solvent passage onto the atomizing head outer peripheral surface, and the paint particle having adhered to the atomizing head outer peripheral surface is washed by this wash fluid (Patent Document 1).

PRIOR ART DOCUMENT

Patent Document

Patent Document 1: Japanese Patent Laid-Open No. Hei10-156224 A

SUMMARY OF THE INVENTION

Incidentally, in the rotary atomizing head type coating machine according to Patent Document 1, apart of the wash fluid ejected from the feed tube is guided onto the atomizing head outer peripheral surface of the rotary atomizing head through the solvent passage. However, since the rotary atomizing head is rotated at high speeds, the wash fluid having flowed out from the solvent passage tends to easily spread out to a radial outside by centrifugal forces. Thereby, it is difficult to effectively supply the wash fluid to the paint particle having adhered to the atomizing head outer peripheral surface. Therefore, in a case of washing the paint particle having adhered to the rotary atomizing head, it is necessary to stop a paint coating line and wash the paint manually, leading to a problem of a reduction in productivity and workability.

The present invention is made in view of the foregoing problems in the conventional technology, and an object of the present invention is to provide a rotary atomizing head type coating machine that can efficiently wash paint having adhered to an atomizing head outer peripheral surface of a rotary atomizing head to improve productivity and workability.

A rotary atomizing head type coating machine according to the present invention comprises an air motor that uses compressed air as a power source, a hollow rotational shaft that is rotatably supported by the air motor and a tip end of which projects to a front side from the air motor, a feed tube that extends to the tip end of the rotational shaft through in the rotational shaft to supply paint or wash fluid, a rotary atomizing head a base end side of which is formed of a cylindrical section mounted to the tip end of the rotational shaft and a portion closer to a front side than the cylindrical section of which is formed of a cup section enlarged in a cup shape to spray paint from a tip end of the cup section, a shaping air ring that is arranged on an outer peripheral side of the rotary atomizing head has a ring inner peripheral surface facing an atomizing head outer peripheral surface of the rotary atomizing head with an annular clearance and has many shaping air spurting holes on a front end surface to spurt shaping air, and an assist air spurting hole that is provided to open to the ring inner peripheral surface of the shaping air ring and spurts assist air into the annular clearance defined between the ring inner peripheral surface and the atomizing head outer peripheral surface of the rotary atomizing head.

The configuration adopted by the present invention is characterized in that the rotary atomizing head is provided with an outer peripheral surface washing passage open onto the atomizing head outer peripheral surface for causing the wash fluid supplied from the feed tube to flow out into the annular clearance, and an outflow opening of the outer peripheral surface washing passage is provided in a position closer to the backside into the annular clearance than a tip end of the shaping air ring and opens into the annular clearance in an angle that is an acute angle to the atomizing head outer peripheral surface of the rotary atomizing head.

According to the present invention, since it is possible to efficiently wash the paint having adhered onto the atomizing head outer peripheral surface of the rotary atomizing head, the manual washing work can be eliminated to improve the productivity and workability.

MODE FOR CARRYING OUT THE INVENTION

Hereinafter, a rotary atomizing head type coating machine according to an embodiment of the present invention will be in detail explained with reference to the accompanying drawings.

First, FIG. 1 to FIG. 4 show a first embodiment of the present invention. The first embodiment will be explained by taking a rotary atomizing head type coating machine provided with a rotary atomizing head having a diameter dimension of approximately 70 mm, as an example.

Figure 1:
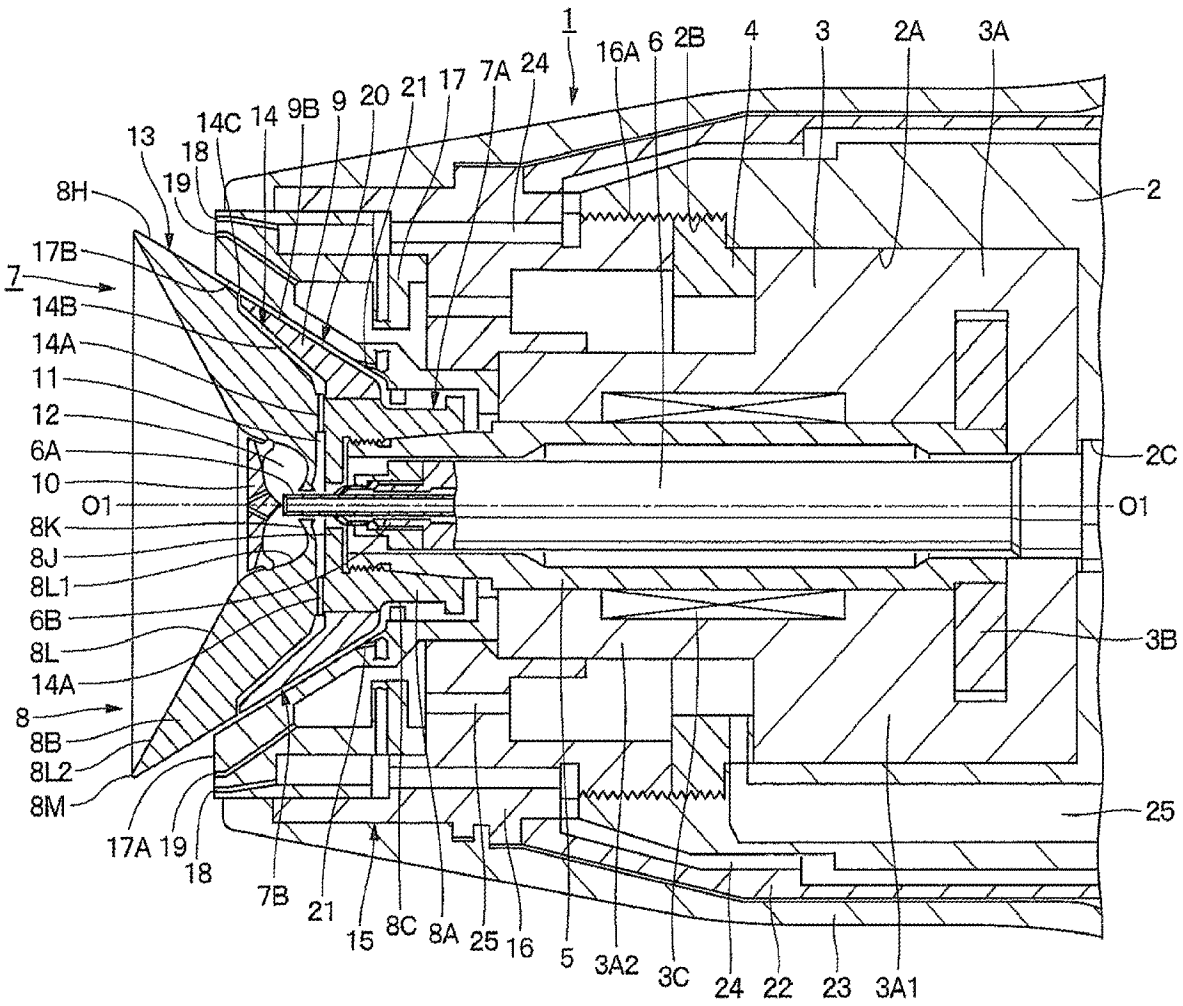
FIG. 1 is a longitudinal cross section showing a rotary atomizing head type coating machine according to a first embodiment in the present invention.

In FIG. 1, a rotary atomizing head type coating machine 1 according to the first embodiment is configured as, for example, an electrostatic coating machine of a direct charging type that applies high voltages directly to paint by a high voltage generator (not shown). The rotary atomizing head type coating machine 1 is mounted to a tip end of an arm (not shown) of a paint coating robot, for example. The rotary atomizing head type coating machine 1 includes a housing 2, an air motor 3, a rotational shaft 5, a feed tube 6, a rotary atomizing head 7, a shaping air ring 15 and an assist air spurting holes 21, which will be described later.

The housing 2 is mounted to the tip end of the arm in the paint coating robot at the base end side. The housing 2 is provided with a motor accommodating part 2A to open to the front end side, and a female screw part 2B is provided in the opening side of the motor accommodating part 2A to be positioned in an inner peripheral side enlarged by one step. Further, the housing 2 is provided with an insertion hole 2C in a central position (position of an axis line O1-O1 of the rotational shaft 5 to be described later) of a bottom part in the motor accommodating part 2A for insertion and fit of the base end side of the feed tube 6 to be described later.

The air motor 3 is provided coaxially with the axis line O1-O1 in the motor accommodating part 2A in the housing 2. The air motor 3 rotates the rotational shaft 5 and the rotary atomizing head 7 to be described later at high speeds of, for example, 3000 to 150000 rpm by using compressed air as a power source. The air motor 3 includes a stepped cylindrical motor case 3A mounted in the front side of the housing 2, a turbine 3B that is rotatably accommodated in the motor case 3A to be positioned closer to the rear side of the motor case 3A, and an air bearing 3C that is provided in the motor case 3A to rotatably support the rotational shaft 5.

The motor case 3A of the air motor 3 is formed as a cylindrical body having the axis line O1-O1 of the rotational shaft 5 as a center line. The motor case 3A is formed in a stepped cylindrical shape by a large diameter cylinder 3A1 of a large diameter inserted/fitted in the motor accommodating part 2A of the housing 2 and a small diameter cylinder 3A2 of a small diameter projecting to the front side from a tip end (front end) of the large diameter cylinder 3A1.

The turbine 3B rotates the rotational shaft 5 at high speeds by spraying turbine air (compressed air) toward an impeller (not shown) composed of a plurality of vanes successively provided in the circumferential direction. The air bearing 3C is mounted on an inner peripheral side of the motor case 3A. The air bearing 3C sprays the supplied bearing air (compressed air) onto the outer peripheral surface of the rotational shaft 5 to rotatably support the rotational shaft 5 through an annular air layer.

The large diameter cylinder 3A1 in the motor case 3A is inserted/fitted in the motor accommodating part 2A of the housing 2. In this state, the motor case 3A is mounted integrally in the housing 2 by screwing an annular retaining member 4 into the female screw part 2B of the housing 2.

Figure 2:
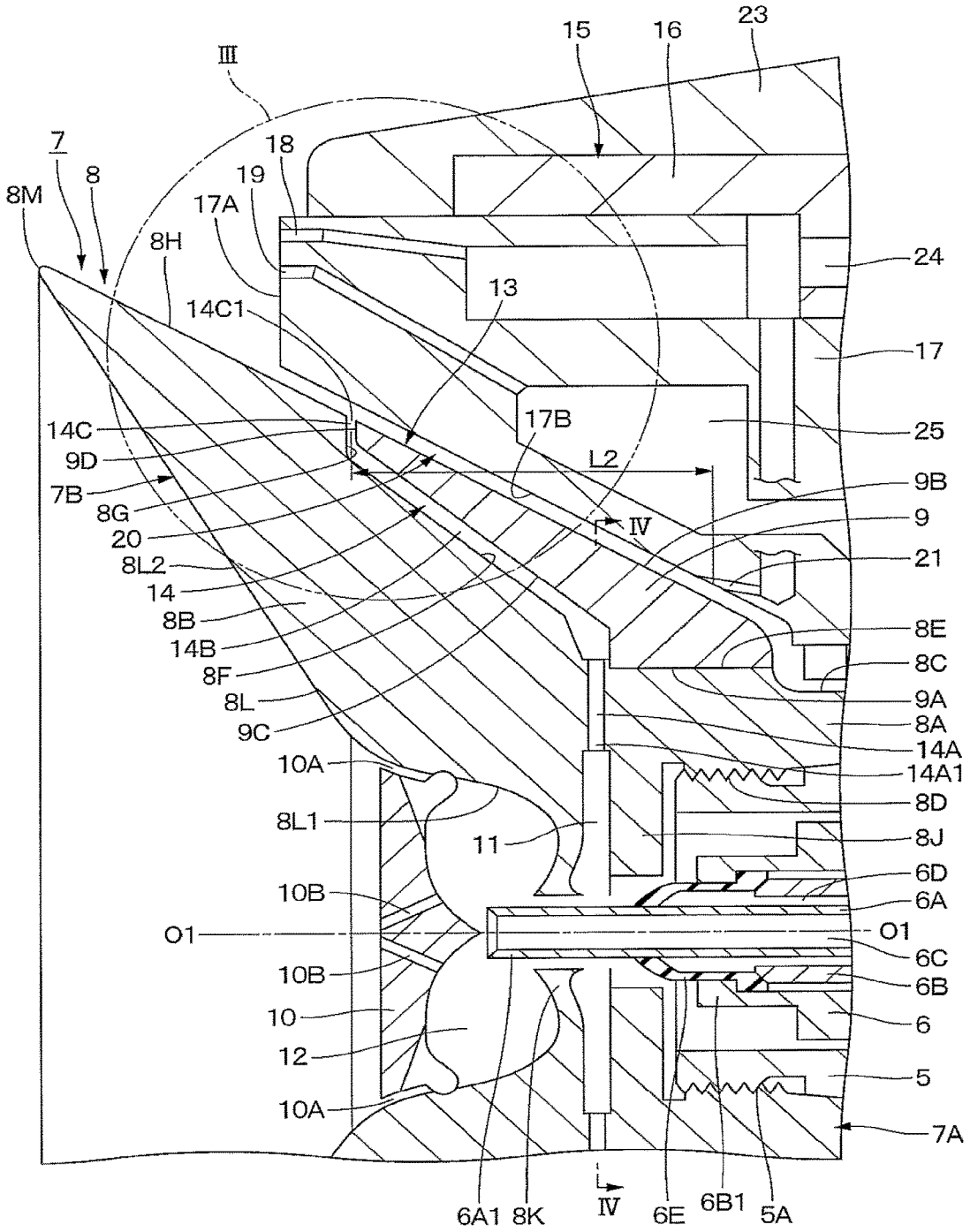
FIG. 2 is a longitudinal cross section showing a front part of the rotary atomizing head type coating machine in FIG. 1 in an enlarging manner.

The rotational shaft 5 is formed as a hollow tubular body that is rotatably supported on the air motor 3 through the air bearing 3C. The rotational shaft 5 is arranged in the motor case 3A to extend axially at the center of the axis line O1-O1. The rotational shaft 5 has a base end side (rear end side) that is mounted in the center of the turbine 3B and a tip end that projects to the front side from the motor case 3A. As shown in FIG. 2, a male screw part 5A is formed in a front end part reduced in diameter of the rotational shaft 5 to mount the rotary atomizing head 7.

The feed tube 6 supplies paint or wash fluid toward the rotary atomizing head 7 and extends through an inside of the rotational shaft 5 to the tip end of the rotational shaft 5. A front end side of the feed tube 6 projects from the tip end of the rotational shaft 5 and extends into the rotary atomizing head 7. On the other hand, a base end side of the feed tube 6 is inserted/fitted in the insertion hole 2C of the housing 2 in a positioned state.

The feed tube 6 is formed with an inner tube 6A that extends coaxially with the axis line O1-O1 and through which paint or wash fluid flows and an outer tube 6B that is positioned on an outer peripheral side of the inner tube 6A for flow of wash fluid between the inner tube 6A and the outer tube 6B. Thereby, the feed tube 6 is formed as a double tube as a whole. The inner tube 6A is provided therein with a paint supplying passage 6C through which paint or wash fluid flows. On the other hand, an annular wash fluid supplying passage 6D is formed between the inner tube 6A and the outer tube 6B for flow of the wash fluid. The paint supplying passage 6C is connected to a paint supplying source (not shown) for a color changing valve device and the like, and the wash fluid supplying passage 6D is connected to a wash fluid supplying source (not shown). Further, as shown in FIG. 2, the inner tube 6A is formed axially longer than the outer tube 6B. Therefore, a front end part of the inner tube 6A is formed as a projecting section 6A1 projecting forward from a front end section 6B1 of the outer tube 6B.

A check valve 6E is provided in the front end section 6B1 of the outer tube 6B. The check valve 6E is formed in a cylindrical shape using a resin material, a rubber material or the like having elasticity, for example, using a fluorinated resin material. The check valve 6E, for preventing wash fluid (particularly, solvent) from dripping off, closes in close contact with an outer peripheral surface of the inner tube 6A with elastic forces regularly to seal an opening side of the wash fluid supplying passage 6D. On the other hand, the check valve 6E opens against supply pressures of the wash fluid when the wash fluid is supplied from the wash fluid supplying passage 6D to allow for ejection of the wash fluid from the wash fluid supplying passage 6D.

Next, an explanation will be in detail made of the configuration of the rotary atomizing head 7 that is a characteristic part of the first embodiment.

The rotary atomizing head 7 is mounted in a tip end of the rotational shaft 5, and is formed in a cup shape enlarged from the rear side to the front side. The rotary atomizing head 7 rotates together with the rotational shaft 5 at high speeds by the air motor 3 to spray paint and the like supplied from the feed tube 6. The rotary atomizing head 7 includes an atomizing head body 8, an annular cover 9, a hub member 10, and an outer peripheral surface washing passage 14.

On the other hand, as shown in FIG. 1, the rotary atomizing head 7 has a base end side that constitutes a cylindrical section 7A mounted to the tip end of the rotational shaft 5 and a portion closer to a front side than the cylindrical section 7A that constitutes a cup section 713 enlarged in a cup shape toward the front side. Here, the cylindrical section 7A is formed by a mounting part 8A of the atomizing head body 8.

Further, the cup section 7B is formed by a flared part 8B in the atomizing head body 8 and the annular cover 9. The annular cover 9 forms the outer peripheral surface washing passage 14 to be described later between the flared part 8B of the atomizing head body 8 and the annular cover 9 for flow of the wash fluid. In addition, the annular cover 9 forms an annular clearance 20 to be described later in cooperation with a front outer peripheral surface 8H of the atomizing head body 8, the annular clearance 20 being formed of an approximately constant clearance between a ring inner peripheral surface 17B of a front ring section 17 forming the shaping air ring 15 and the annular cover 9. The configuration of the annular cover 9 will be in detail described later.

The atomizing head body 8 constituting a body part of the rotary atomizing head 7 has a base end side that is formed as the mounting part 8A mounted in the tip end of the rotational shaft 5. The mounting part 8A constitutes the cylindrical section 7A of the rotary atomizing head 7. The atomizing head body 8 constitutes the flared part 8B enlarged toward the front side in front of the mounting part 8A. Here, the mounting part 8A is formed in a cylindrical shape, and an outer peripheral side thereof is formed as a cylindrical surface 8C that constitutes a part of an atomizing head outer peripheral surface 13 to be described later. On the other hand, a female screw part 8D is provided in the depth of the mounting part 8A on the inner peripheral side (aftermentioned wash fluid partition wall 8J-side), and the female screw part 8D is screwed into the male screw part 5A provided in the tip end of the rotational shaft 5.

As shown in FIG. 2, on an outer peripheral side of the atomizing head body 8, a portion positioned on the outside of the aforementioned female screw part 8D constitutes a cylindrical mounting surface 8E. The annular cover 9 is fixedly mounted on the mounting surface 8E.

A front section from the mounting surface 8E of the atomizing head body 8 constitutes a rear outer peripheral surface 8F enlarged conically toward the front side. A front end of the rear outer peripheral surface 8F constitutes an annular stepped surface 8G extending in a radial outside to be perpendicular to the axis line O1-O1. The rear outer peripheral surface 8F and the stepped surface 8G face a front outer peripheral surface 9C and a front end surface 9D of the annular cover 9 to be described later with an interval, thus forming a part of the outer peripheral surface washing passage 14, that is, a conical passage 14B and an outflow passage 14C to be described later.

Further, a front section from the stepped surface 8G on the outer peripheral side of the atomizing head body 8 constitutes the front outer peripheral surface 8H enlarged conically toward the front side. The front outer peripheral surface 8H constitutes a conical surface of the atomizing head outer peripheral surface 13 to be described later together with a rear outer peripheral surface 9B of the annular cover 9. In this case, the front outer peripheral surface 8H and the rear outer peripheral surface 9B are formed as a smooth conical surface over an entire region in the front-rear direction and over an entire periphery.

On the other hand, an annular wash fluid partition wall 8J is provided on the inner peripheral side of the atomizing head body 8. The wash fluid partition wall 8J is provided to project in a radial inside in a front vicinity position of the female screw part 8D, that is, in a position facing the front end section 6B1 of the outer tube 6B in the feed tube 6. In addition, an annular paint partition wall 8K projecting in a radial inside is provided in front of the wash fluid partition wall 8J and in a position of surrounding the projecting section 6A1 of the inner tube 6A.

The inner peripheral side of the atomizing head body 8 constitutes a cup-shaped inner peripheral surface 8L, which is formed by gradually enlarging a portion thereof closer to the front side than the paint partition wall 8K toward the front side. The cup-shaped inner peripheral surface 8L is formed by a recessed inner peripheral surface 8L1 forming a peripheral wall of a paint reservoir 12 and a paint spreading surface 8L2 enlarged toward the front side from the recessed inner peripheral surface 8L1. The recessed inner peripheral surface 8L1 is positioned between the paint partition wall 8K and the hub member 10 to form the paint reservoir 12 to be described later. The paint spreading surface 8L2 causes the paint having flowed out from the paint reservoir 12 to spread and flow toward the front side, and the tip end (front end) constitutes a releasing edge 8M for releasing the spread paint as paint particles.

The annular cover 9 is provided on the outer peripheral side of the atomizing head body 8 and is formed as a conical body enlarged toward the front side. As shown in FIG. 2, the annular cover 9 is provided with a mounting part 9A wide in width in the base end side (inner diameter side) and is formed to be gradually thinner in width toward the front side from the mounting part 9A. The annular cover 9 constitutes a part of the rotary atomizing head 7, and the mounting part 9A thereof is integrally mounted on an outer periphery of the mounting surface 8E in the atomizing head body 8. In this state, the annular cover 9 is shaped to be accommodated in a portion recessed by the rear outer peripheral surface 8F and the stepped surface 8G of the atomizing head body 8.

Specifically, the outer peripheral side of the annular cover 9 constitutes the conical rear outer peripheral surface 9B enlarged toward the front side from the tip end of the cylindrical surface 8C. The rear outer peripheral surface 9B has no unevenness to the front outer peripheral surface 8H of the atomizing head body 8 and is smoothly connected to the front outer peripheral surface 8H. The rear outer peripheral surface 9B constitutes a conical surface smooth over an entire region in the front-rear direction and over an entire periphery, that is, a conical surface of the atomizing head outer peripheral surface 13 to be described later together with the front outer peripheral surface 8H of the atomizing head body 8.

On the other hand, an inner peripheral side of the annular cover 9 constitutes the front outer peripheral surface 9C facing the rear outer peripheral surface 8F of the atomizing head body 8. A front end of the front outer peripheral surface 9C constitutes the annual front end surface 9D extending in a radial outside to be perpendicular to the axis line O1-O1 of the rotational shaft 5. The front outer peripheral surface 9C and the front end surface 9D face the rear outer peripheral surface 8F and the stepped surface 8G of the atomizing head body 8 with an interval, respectively, thus forming a part of the outer peripheral surface washing passage 14, that is, the conical passage 14B and the outflow passage 14C to be described later.

The hub member 10 is provided on the cup-shaped inner peripheral surface 8L of the flared part 8B in front of the paint partition wall 8K of the atomizing head body 8, and is formed as a disk-shaped body. The hub member 10 is arranged in a boundary position between the recessed inner peripheral surface 8L1 of the cup-shaped inner peripheral surface 8L and the paint spreading surface 8L2 to seal the front side in the paint reservoir 12. Many hub paint passages 10A (two only are shown), which cause paint or wash fluid to flow out to the paint spreading surface 8L2, are provided in the circumferential direction on the outer peripheral side of the hub member 10 to be positioned between the recessed inner peripheral surface 8L1 and the outer peripheral side of the hub member 10. A plurality of hub wash fluid passages 10B (two only are shown) are provided in a position closer to the center of the hub member 10 to cause the wash fluid to flow out onto the front surface.

A wash fluid reservoir 11 is provided between the wash fluid partition wall 8J and the paint partition wall 8K of the atomizing head body 8. The wash fluid reservoir 11 is formed as an annular space part for reserving the wash fluid having flowed out from the wash fluid supplying passage 6D of the feed tube 6. The inflow opening 14A1 of a radial passage 14A constituting the outer peripheral surface washing passage 14 to be described later is communicated with and opens to the wash fluid reservoir 11.

The paint reservoir 12 is provided between the paint partition wall 8K of the atomizing head body 8 and the hub member 10. The paint reservoir 12 is formed as an approximately semispherical-shaped space part for reserving the paint having flowed out from the paint supplying passage 6C of the feed tube 6. The paint reservoir 12 is a space for temporally reserving the paint or wash fluid having flowed out from the paint supplying passage 6C and scattering it.

The atomizing head outer peripheral surface 13 is formed as an outer peripheral surface of the rotary atomizing head 7. The atomizing head outer peripheral surface 13 is formed by the cylindrical section 7A and the cup section 7B enlarged in a cup shape toward the front side. More specifically, the atomizing head outer peripheral surface 13 is formed by the cylindrical surface 8C positioned on the outer peripheral side of the mounting part 8A in the atomizing head body 8, the rear outer peripheral surface 9B positioned on the outer peripheral side of the annular cover 9 and the front outer peripheral surface 8H positioned on the outer peripheral side of the flared part 8B of the atomizing head body 8. Thereby, the atomizing head outer peripheral surface 13 is formed in a conical surface shape such as a trumpet shape or a cup shape gradually enlarged toward the front side as a whole.

Here, the atomizing head outer peripheral surface 13 is formed as a conical outer peripheral surface smooth over an entire region in the front-rear direction and over an entire periphery by connecting the front outer peripheral surface 8H and the rear outer peripheral surface 9B with no unevenness. Therefore, the atomizing head outer peripheral surface 13 can keep the annular clearance 20 formed between the ring inner peripheral surface 17B of the front ring section 17 constituting the shaping air ring 15 to be described later and the atomizing head outer peripheral surface 13 to an approximately constant clearance dimension with a small clearance.

Next, an explanation will be in detail made of the configuration and function of the outer peripheral surface washing passage 14 that is a characteristic part of the first embodiment.

The outer peripheral surface washing passage 14 is provided in the flared part 8B of the atomizing head body 8 to be positioned on the outer peripheral side in the flared part 8B of the atomizing head body 8 and open onto the atomizing head outer peripheral surface 13. The outer peripheral surface washing passage 14 causes the wash fluid supplied through the wash fluid supplying passage 6D of the feed tube 6 to flow out to the annular clearance 20 to be described later. Here, the outer peripheral surface washing passage 14 communicates the wash fluid reservoir 11 of the atomizing head body 8 with the atomizing head outer peripheral surface 13 (annular clearance 20), and includes the radial passage 14A, the conical passage 14B and the outflow passage 14C in order from the upstream side in a flowing direction of wash fluid.

Figure 4:
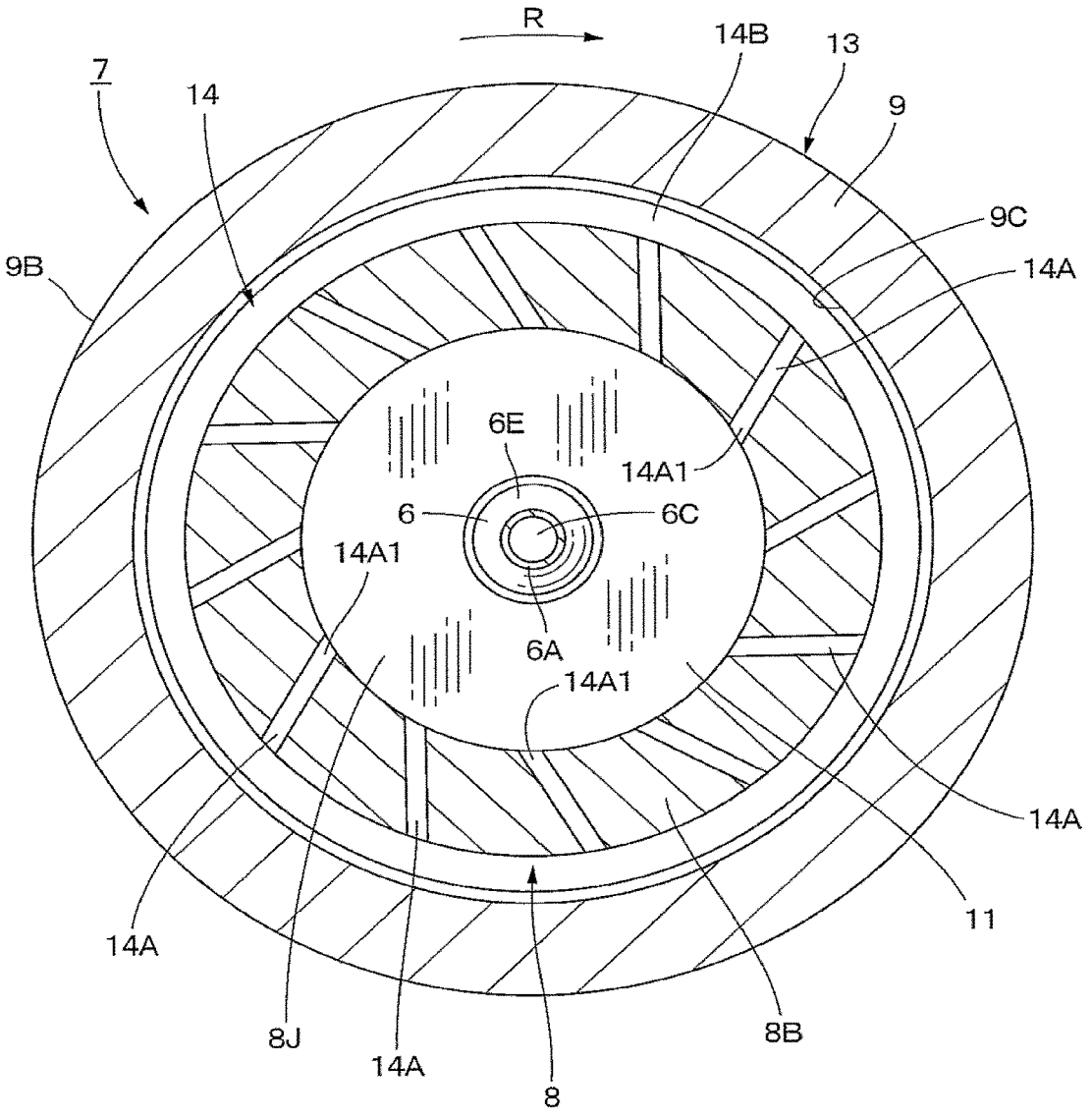
FIG. 4 is a transverse cross section showing a rotary atomizing head as viewed in a direction of arrows IV-IV in FIG. 2.

The radial passage 14A constituting the upstream section in the outer peripheral surface washing passage 14 includes a plurality of radial passages provided in the atomizing head body 8 in the circumferential direction by given intervals (refer to FIG. 4). Each of the radial passages 14A is arranged between the wash fluid partition wall 8J and the paint partition wall 8K of the atomizing head body 8. An inner diameter side of each of the radial passages 14A constitutes an inflow opening 14A1. The inflow opening 14A1 is communicated with the wash fluid reservoir 11 in the vicinity position of a check valve 6E (front end section 6B1 of the outer tube 6B) of the outer tube 6B in the feed tube 6, that is, to be perpendicular to the axis line O1-O1 of the rotational shaft 5 and to open in a radial inward.

In addition, as shown in FIG. 4, each of the radial passages 14A is composed of a small-diameter passage extending from an inner diameter side to an outer diameter side, and is arranged to be inclined in a direction opposing a rotational direction (arrow R direction in FIG. 4) of the rotary atomizing head 7. Therefore, each of the radial passages 14A can cause the wash fluid reserved in the wash fluid reservoir 11 to flow in efficiently.

The conical passage 14B constituting an intermediate section of the outer peripheral surface washing passage 14 is formed as an entire peripheral space between the rear outer peripheral surface 8F of the atomizing head body 8 and the front outer peripheral surface 9C of the annular cover 9. Specifically, the conical passage 14B is formed as a thin conical tubular space (clearance) gradually enlarged toward the front side from the end on an outer diameter side in each of the radial passages 14A.

The outflow passage 14C constituting a downstream section of the outer peripheral surface washing passage 14 is formed as an entire peripheral space (clearance) between the stepped surface 8G of the atomizing head body 8 and the front end surface 9D of the annular cover 9. Here, as shown in FIG. 2, an outflow opening 14C1 positioned on an outer diameter side in the outflow passage 14C is provided to be perpendicular to the axis line O1-O1 of the rotational shaft 5 and opens in a radial outward between the front outer peripheral surface 8H of the atomizing head body 8 and the rear outer peripheral surface 9B of the annular cover 9 constituting the atomizing head outer peripheral surface 13.

Here, an explanation will be in detail made of the configuration of the outflow passage 14C in the outer peripheral surface washing passage 14.

Figure 3:
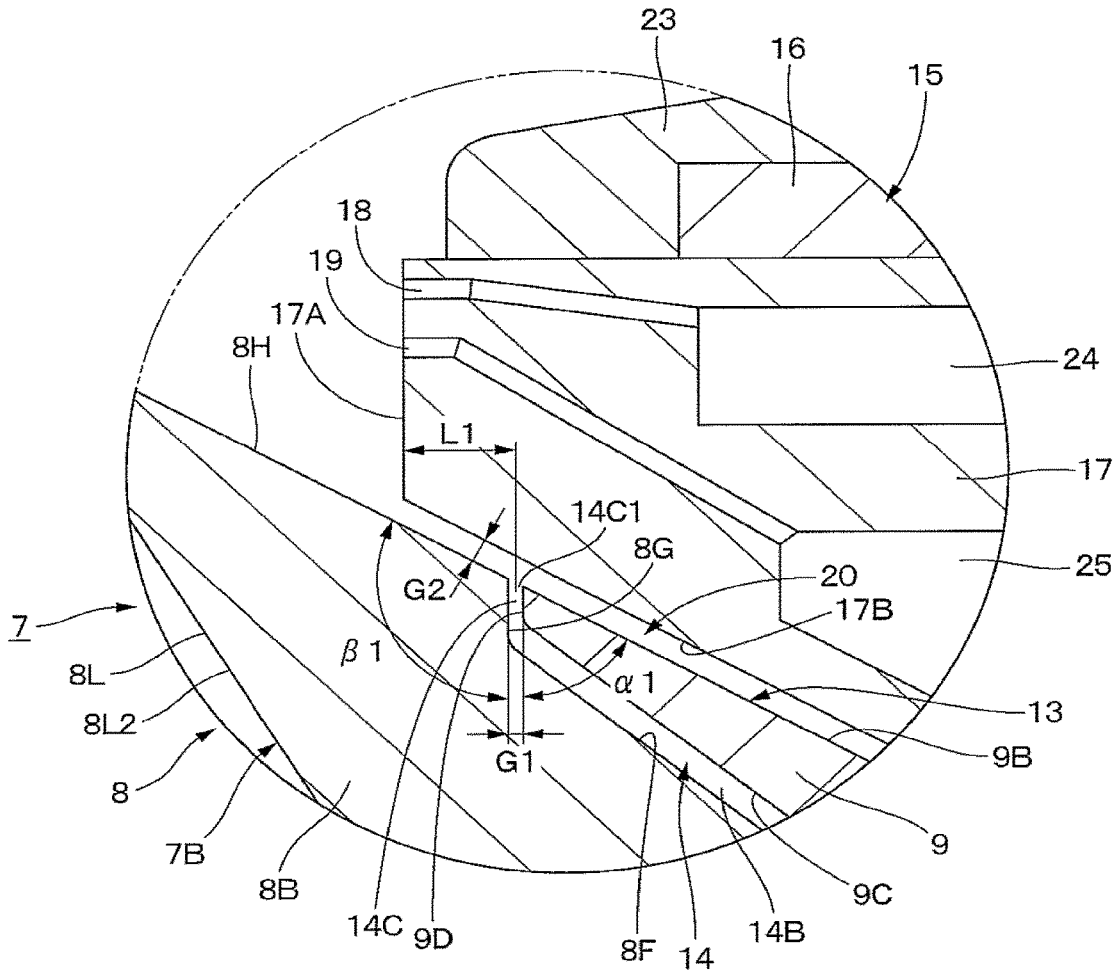
FIG. 3 is a longitudinal cross section showing III part in FIG. 2 in an enlarging manner.

As shown in FIG. 3, the outflow opening 14C1 in the outflow passage 14C is provided in a position closer to the rear side into the annular clearance 20 by an axial length dimension L1 than a front end surface 17A of the shaping air ring 15 to be described later. The length dimension L1 showing the rear side position of the outflow opening 14C1 is set according to the following formula 1.

$$1.0\ \text{mm} \leq L1 \leq 7.0\ \text{mm}, \quad \text{[Formula 1]}$$

preferably, 2.0 mm≤L1≤4.0 mm

Thus, the outflow opening 14C1 is arranged to go backward in the annular clearance 20, and thereby, it is possible to cause the wash fluid flowing out from the outflow opening 14C1 to collide with the ring inner peripheral surface 17B in the shaping air ring 15. Thereby, the wash fluid flowing out from the outflow opening 14C1 can be guided to the front end surface 17A of the shaping air ring 15 by centrifugal forces to cause the wash fluid to flow along the atomizing head outer peripheral surface 13 (front outer peripheral surface 8H).

The outflow opening 14C1 of the outflow passage 14C opens on the atomizing head outer peripheral surface 13 positioned on the outer peripheral side of the flared part 8B in the atomizing head body 8 (rotary atomizing head 7) to be perpendicular to the axis line O1-O1 of the rotational shaft 5. On the other hand, the atomizing head outer peripheral surface 13 is formed as a conical shape enlarged toward the front side. Accordingly, as shown in FIG. 3, when an angle between the rear outer peripheral surface 9B and the front end surface 9D in the annular cover 9 is indicated at α1, the outflow opening 14C1 of the outflow passage 14C is communicated with the annular clearance 20 at an angle α1 that is an acute angle to the atomizing head outer peripheral surface 13. Thereby, since the wash fluid flowing out from the outflow opening 14C1 of the outflow passage 14C collides at an acute angle with the ring inner peripheral surface 17B in the shaping air ring 15, the wash fluid is smoothly transmitted to the atomizing head outer peripheral surface 13 (front outer peripheral surface 8H). It should be noted that when the angle α1 of the outflow passage 14C is an acute angle, an angle β1 between the front outer peripheral surface 8H and the stepped surface 8G in the flared part 8B becomes an obtuse angle.

In this case, it is preferable that the angle α1 is an angle as acute as possible, and is set as the following formula 2.

$$20° \leq \alpha 1 \leq 75° \quad \text{[Formula 2]}$$

Further, the outflow opening 14C1 of the outflow passage 14C is provided to be perpendicular to the axis line O1-O1 of the rotational shaft 5 and opens in a radial outward toward the annular clearance 20. The outflow passage 14C is formed as an annular space for communicating the conical passage 14B with the annular clearance 20 with a small clearance dimension G1 in an axial direction of the rotational shaft 5. The clearance dimension G1 of the outflow passage 14C is set to a small value as the following formula 3 in such a manner that the wash fluid flowing in the outflow passage 14C necessarily makes contact with the stepped surface 8G of the atomizing head body 8.

$$0.2\ \text{mm} \leq G1 \leq 0.7\ \text{mm}, \quad \text{[Formula 3]}$$

preferably, 0.2 mm≤G1≤0.5 mm

Here, when the rotary atomizing head 7 rotates at high speeds, the wash fluid can flow along the stepped surface 8G of the atomizing head body 8 and the front end surface 9D of the annular cover 9 and flow out into the outflow opening 14C1. Thereby, it is possible to efficiently supply the wash fluid toward the front outer peripheral surface 8H.

Paint is supplied from the paint supplying passage 6C in the feed tube 6 to the rotary atomizing head 7 as thus configured in a state where the rotary atomizing head 7 is being rotated at high speeds by the air motor 3. At this time, the paint supplied from the feed tube 6 reaches the releasing edge 8M through the paint reservoir 12, each of the hub paint passages 10A of the hub member 10 and the paint spreading surface 8L2 of the atomizing head body 8. The paint having reached the releasing edge 8M is sprayed as paint particles micronized by centrifugal forces of the rotary atomizing head 7. In addition, in a case of washing the paint having adhered to the paint reservoir 12, each of the hub paint passages 10A of the hub member 10, the paint spreading surface 8L2 of the atomizing head body 8 and the releasing edge 8M, it is possible to wash these sections by rotating the rotary atomizing head 7 at high speeds and supplying the wash fluid from the paint supplying passage 6C in the feed tube 6.

On the other hand, an explanation will be made of a case of washing the paint having adhered to the front outer peripheral surface 8H of the atomizing head body 8 constituting a conical surface in the atomizing head outer peripheral surface 13 of the rotary atomizing head 7. In this case, the wash fluid is supplied from the wash fluid supplying passage 6D in the feed tube 6 while rotating the rotary atomizing head 7 at high speeds. As a result, since the wash fluid is supplied to the front outer peripheral surface 8H through the wash fluid reservoir 11 and the outer peripheral surface washing passage 14, it is possible to wash the paint having adhered to the front outer peripheral surface 8H by the wash fluid.

Next, an explanation will be made of the shaping air ring 15, and first and second shaping air spurting holes 18, 19.

The shaping air ring 15 is arranged on the outer peripheral side of the rotary atomizing head 7 and adjusts a spraying pattern of paint sprayed from the rotary atomizing head 7. The shaping air ring 15 includes a rear ring section 16, the front ring section 17, the first shaping air spurting hole 18 and the second shaping air spurting hole 19.

As shown in FIG. 1, the rear ring section 16 is formed as a stepped cylindrical body mounted in the housing 2 to surround a front section of the air motor 3. A rear part outer periphery of the rear ring section 16 is provided with a male screw part 16A screwed into the female screw part 2B of the housing 2.

The front ring section 17 is formed as a stepped cylindrical body mounted in a front section of the rear ring section 16 to surround the rotary atomizing head 7. The front end surface 17A of the front ring section 17 is arranged in a position projecting closer to the front side by the aforementioned length dimension L1 than the outflow passage 14C of the outer peripheral surface washing passage 14. The front end surface 17A is provided with the first shaping air spurting hole 18 and the second shaping air spurting hole 19.

The front ring section 17 has the ring inner peripheral surface 17B facing the atomizing head outer peripheral surface 13 of the rotary atomizing head 7 with a clearance. The ring inner peripheral surface 17B is formed to extend forward to the front end surface 17A over the outflow passage 14C of the outer peripheral surface washing pas sage 14 from the base end position of the annular cover 9.

The ring inner peripheral surface 17B is formed as a recessed conical surface enlarged at the same angle with the atomizing head outer peripheral surface 13 to face the atomizing head outer peripheral surface 13 with an approximately constant clearance dimension. In this way, the annular clearance 20 to be described later is defined between the ring inner peripheral surface 17B and the atomizing head outer peripheral surface 13.

The first shaping air spurting holes 18 are numerously provided in the circumferential direction to be positioned closer to the outer periphery of the front end surface 17A of the front ring section 17. Each of the first shaping air spurting holes 18 spurts shaping air toward the releasing edge 8M of the rotary atomizing head 7 to adjust the spraying pattern of the paint sprayed from the releasing edge 8M. Each of the first shaping air spurting holes 18 is connected to a first air source (not shown) through a first shaping air passage 24 to be described later.

The second shaping air spurting holes 19 are numerously provided on the front end surface 17A of the front ring section 17 to be positioned on the inner peripheral side of the first shaping air spurting holes 18. Each of the second shaping air spurting holes 19 spurts shaping air along the front section of the atomizing head outer peripheral surface 13 in the rotary atomizing head 7 as similar to each of the first shaping air spurting holes 18. Each of the second shaping air spurting holes 19 is connected to a second air source (not shown) through a second shaping air passage 25 to be described later.

Next, an explanation will be made of the annular clearance 20 provided between the outer peripheral surface of the rotary atomizing head 7 and the inner peripheral surface of the shaping air ring 15 and the assist air spurting hole 21 provided in the shaping air ring 15.

The annular clearance 20 is defined between the ring inner peripheral surface 17B of the front ring section 17 constituting the shaping air ring 15 and the atomizing head outer peripheral surface 13 in the rotary atomizing head 7. The annular clearance 20 is formed as a thin space in a conical shape (trumpet shape) enlarged toward the front side along the ring inner peripheral surface 17B and the atomizing head outer peripheral surface 13. Here, as shown in FIG. 3, a clearance dimension G2 (thickness dimension of a space) of the annular clearance 20 is set to a small value as the following formula 4 in a case of the rotary atomizing head 7 having a diameter dimension of 70 mm (ϕ70).

$$0.4\ \text{mm} \le G2 \le 1.1\ \text{mm}, \qquad \text{[Formula 4]}$$

preferably, 0.5 mm≤G2≤0.8 mm

The clearance dimension G2 of the annular clearance 20 is set to the small value in this way, and therefore, it is possible to cause assist air to be described later to certainly act on the wash fluid flowing out into the annular clearance 20 from the outer peripheral surface washing passage 14. Thereby, it is possible to stably supply the wash fluid to the front section of the atomizing head outer peripheral surface 13 to improve a washing efficiency of the atomizing head outer peripheral surface 13. In addition, it is possible to prevent reverse flow of the paint or wash fluid.

The assist air spurting hole 21 opens onto the ring inner peripheral surface 17B of the front ring section 17 constituting the shaping air ring 15 in the backside position of the flared part 8B (rear outer peripheral surface 9B of the annular cover 9) of the atomizing head body 8 constituting the rotary atomizing head 7. In this case, the assist air spurting hole 21 opens to the forward side along the axis line O1-O1 of the rotational shaft 5. Further specifically, the assist air spurting hole 21 is composed of small holes numerously formed in the circumferential direction and opens to be slightly inclined in a radial outside to the axis line O1-O1 of the rotational shaft 5 (for example, approximately 20 degrees). Each of the assist air spurting holes 21 is connected to, for example, the first shaping air passage 24. Each of the assist air spurting holes 21 spurts assist air (purge air) into the annular clearance 20, thereby making it possible to prevent the paint or wash fluid from reversely flowing to the annular clearance 20. Further, each of the assist air spurting holes 21 can smoothly guide the wash fluid flowing out into the annular clearance 20 from the outer peripheral surface washing passage 14 toward the tip end of the shaping air ring 15.

Here, in a case of arranging each of the assist air spurting holes 21, a distance relation to the outflow passage 14C (outflow opening 14C1) of the outer peripheral surface washing passage 14 is important, and an axial length dimension L2 is set to a value of the following formula 5.

$$13\ \text{mm} \le L2 \le 23\ \text{mm}, \qquad \text{[Formula 5]}$$

preferably, 16 mm≤L2≤20 mm

It should be noted that as shown in FIG. 1, an inner cover 22 is provided surrounding the housing 2, and a front end part thereof is fitted in the rear ring section 16 of the shaping air ring 15 from outside. An outer cover 23 constitutes an outer peripheral surface of the rotary atomizing head type coating machine 1, and surrounds the shaping air ring 15 and the inner cover 22.

The first shaping air passage 24 supplies compressed air from the first air source to each of the first shaping air spurting holes 18. The first shaping air passages 24 are provided, for example, between the housing 2 and the inner cover 22, and in the rear ring section 16 and the front ring section 17 of the shaping air ring 15.

The second shaping air passage 25 supplies compressed air from the second air source to each of the second shaping air spurting holes 19. The second shaping air passages 25 are provided, for example, in the housing 2, between the air motor 3 and the rear ring section 16 of the shaping air ring 15, in the rear ring section 16 and in the front ring section 17.

The rotary atomizing head type coating machine 1 according to the first embodiment has the configuration as described above, and next, an explanation will be made of an operation at the time of performing a coating work using the rotary atomizing head type coating machine 1.

The bearing air is supplied to the air bearing 3C of the air motor 3 and the turbine air is supplied to the turbine 3B in the air motor 3 to rotate the rotational shaft 5. Thereby, the rotary atomizing head 7 is rotated together with the rotational shaft 5 at high speeds. In this state, the paint selected in the color changing valve device (not shown) is supplied to the rotary atomizing head 7 from the paint supplying passage 6C in the inner tube 6A of the feed tube 6, and thereby, the paint can be sprayed as paint particles from the rotary atomizing head 7.

In this case, the rotary atomizing head 7 is formed, for example, by using a metallic material having conductivity, such as a stainless or aluminum alloy. Therefore, for performing a coating work, negative high voltages that are output from the high voltage generator are applied to the feed tube 6, the rotary atomizing head 7 and the like. As a result, it is possible to charge the paint particles sprayed from the rotary atomizing head 7 with negative polarity.

In this way, since the paint particles sprayed from the rotary atomizing head 7 are charged with the negative polarity by the high voltage generator, the charged paint particle flies toward a coated object that is connected to earth, thus making it possible to efficiently apply paint on the coated object.

On the other hand, at the time of spraying the paint from the rotary atomizing head 7, shaping air is spurted from the respective shaping air spurting holes 18, 19 in the shaping air ring 15 for micronization of the sprayed paint and adjustment of the spraying pattern. Thereby, it is possible to cause the shaping air to collide with liquid thread of the paint flying from the rotary atomizing head 7, thus micronizing the paint.

Next, an explanation will be made of a case of washing the paint having adhered to the front section of the atomizing head outer peripheral surface 13 in the rotary atomizing head 7.

First, the wash fluid flows out from the wash fluid supplying passage 6D of the feed tube 6 to the wash fluid reservoir 11 while rotating the rotary atomizing head 7 at high speeds. The wash fluid reserved in the wash fluid reservoir 11 flows out into the annular clearance 20 through the outer peripheral surface washing passage 14 by centrifugal forces. On the other hand, the assist air spurting holes 21 supply assist air into the annular clearance 20. Thereby, the assist air spurted from the assist air spurting holes 21 can smoothly guide the wash fluid flowing out into the annular clearance 20 from the outflow passage 14C in the outer peripheral surface washing passage 14 toward the front outer peripheral surface 8H of the atomizing head body 8. As a result, it is possible to wash the paint having adhered to the atomizing head outer peripheral surface 13 (front outer peripheral surface 8H).

In this way, according to the first embodiment, the outer peripheral surface washing passage 14 open onto the atomizing head outer peripheral surface 13 is provided in the flared part 8B of the atomizing head body 8 that is a part of the cup section 7B of the rotary atomizing head 7. The outer peripheral surface washing passage 14 causes the wash fluid supplied from the feed tube 6 to flow out into the annular clearance 20 between the rotary atomizing head 7 and the shaping air ring 15. The outflow opening 14C1 in the outflow passage 14C constituting the outer peripheral surface washing passage 14 is provided in a position closer to the rear side in the annular clearance 20 than the front end surface 17A of the front ring section 17 constituting the shaping air ring 15. In addition thereto, the outflow opening 14C1 opens to the annular clearance 20 at an angle $\alpha 1$ that is an acute angle to the atomizing head outer peripheral surface 13.

Thereby, the annular clearance 20 can suppress the scattering of the wash fluid flowing out from the outer peripheral surface washing passage 14 to cause the wash fluid to flow to the front end side along the atomizing head outer peripheral surface 13. As a result, since it is possible to certainly wash the paint having adhered to the atomizing head outer peripheral surface 13 in the rotary atomizing head 7, it is possible to eliminate the manual washing work to improve productivity and workability.

In addition, the outflow opening 14C1 of the outer peripheral surface washing passage 14 opens to the annular clearance 20 at an angle $\alpha 1$ that is an acute angle to the atomizing head outer peripheral surface 13. Thereby, it is possible to cause the wash fluid flowing out from the outflow opening 14C1 of the outer peripheral surface washing passage 14 to smoothly flow to the atomizing head outer peripheral surface 13 side, and in this point also, it is possible to efficiently wash the paint having adhered to the atomizing head outer peripheral surface 13.

The feed tube 6 is formed as a double tube by the inner tube 6A that is positioned in the shaft center and through which paint or wash fluid flows and the outer tube 6B that is positioned on the outer peripheral side of the inner tube 6A for flow of wash fluid between the inner tube 6A and the outer tube 6B. The inflow opening 14A1 of the outer peripheral surface washing passage 14 opens in the vicinity of the front end section 6B1 of the outer tube 6B in the feed tube 6.

Accordingly, when the wash fluid flows out from between the inner tube 6A and the outer tube 6B in the feed tube 6, it is possible to cause the wash fluid to actively flow into the inflow opening 14A1 of the outer peripheral surface washing passage 14.

The atomizing head outer peripheral surface 13 of the rotary atomizing head 7 is configured to hold the annular clearance 20 between the ring inner peripheral surface 17B of the shaping air ring 15 and the atomizing head outer peripheral surface 13 to be approximately constant with the small clearance dimension G2. Accordingly, the atomizing head outer peripheral surface 13 can be formed as a smooth surface without concavity and convexity, that is, a smooth conical surface over an entire region in the front-rear direction and over an entire periphery.

Thereby, the assist air spurted into the annular clearance 20 from the assist air spurting holes 21 is not disturbed by concavity and convexity or unevenness at the time of flowing in the annular clearance 20. Therefore, the wash fluid flowing out from the outer peripheral surface washing passage 14 can be guided toward the front outer peripheral surface 8H of the atomizing head body 8. As a result, the assist air can efficiently guide the wash fluid to enhance washing performance of the paint having adhered to the atomizing head outer peripheral surface 13.

The atomizing head body 8 of the rotary atomizing head 7 is provided with the annular wash fluid partition wall 8J projecting in the radial inside in the position facing the front end section 6B1 of the outer tube 6B in the feed tube 6, the annular paint partition wall 8K projecting in the radial inside in front of the wash fluid partition wall 8J and in a position of surrounding the projecting section 6A1 of the inner tube 6A in the feed tube 6, and the hub member 10 provided on the cup-shaped inner peripheral surface 8L of the flared part 8B in front of the paint partition wall 8K and having the hub paint passage 10A on the outer peripheral side. The wash fluid reservoir 11 for reserving the wash fluid supplied from the outer tube 6B of the feed tube 6 is provided between the wash fluid partition wall 8J and the paint partition wall 8K. Further, the paint reservoir 12 for reserving the paint supplied from the inner tube 6A of the feed tube 6 is provided between the paint partition wall 8K and the hub member 10. Besides, the inflow opening 14A1 of the outer peripheral surface washing passage 14 opens to the wash fluid reservoir 11 of the rotary atomizing head 7.

Therefore, the paint supplied from the paint supplying passage 6C of the feed tube 6 is reserved in the paint reservoir 12 between the paint partition wall 8K and the hub member 10. The paint in the paint reservoir 12 flows along the cup-shaped inner peripheral surface 8L through the hub paint passage 10A of the hub member 10 from the paint reservoir 12, and is sprayed from the tip end of the cup-shaped inner peripheral surface 8L. On the other hand, the wash fluid supplied from the wash fluid supplying passage 6D of the feed tube 6 flows out into the wash fluid reservoir 11 between the wash fluid partition wall 8J and the paint partition wall 8K and flows into the outer peripheral surface washing passage 14 in the wash fluid reservoir 11. The wash fluid flowing into the outer peripheral surface washing passage 14 flows along the atomizing head outer peripheral surface 13, making it possible to wash the paint having adhered to the atomizing head outer peripheral surface 13. In this case, since the inflow opening 14A1 of the outer peripheral surface washing passage 14 opens to the wash fluid reservoir 11, the wash fluid in the wash fluid reservoir 11 can smoothly flow into the outer peripheral surface washing passage 14.

The inflow opening 14A1 of the outer peripheral surface washing passage 14 is provided to be perpendicular to the axis line O1-O1 of the rotational shaft 5 and opens in the radial inward. The outflow opening 14C1 of the outer peripheral surface washing passage 14 is provided to be perpendicular to the axis line O1-O1 of the rotational shaft 5 and opens in the radial outward. Further, an angle $\alpha 1$ between the outflow opening 14C1 and the atomizing head outer peripheral surface 13 is made to an acute angle in such a manner that the wash fluid collides at an acute angle with the ring inner peripheral surface 17B of the shaping air ring 15. Accordingly, the wash fluid flowing out from the outer peripheral surface washing passage 14 can smoothly flow into the atomizing head outer peripheral surface 13 (front outer peripheral surface 8H).

Figure 5:
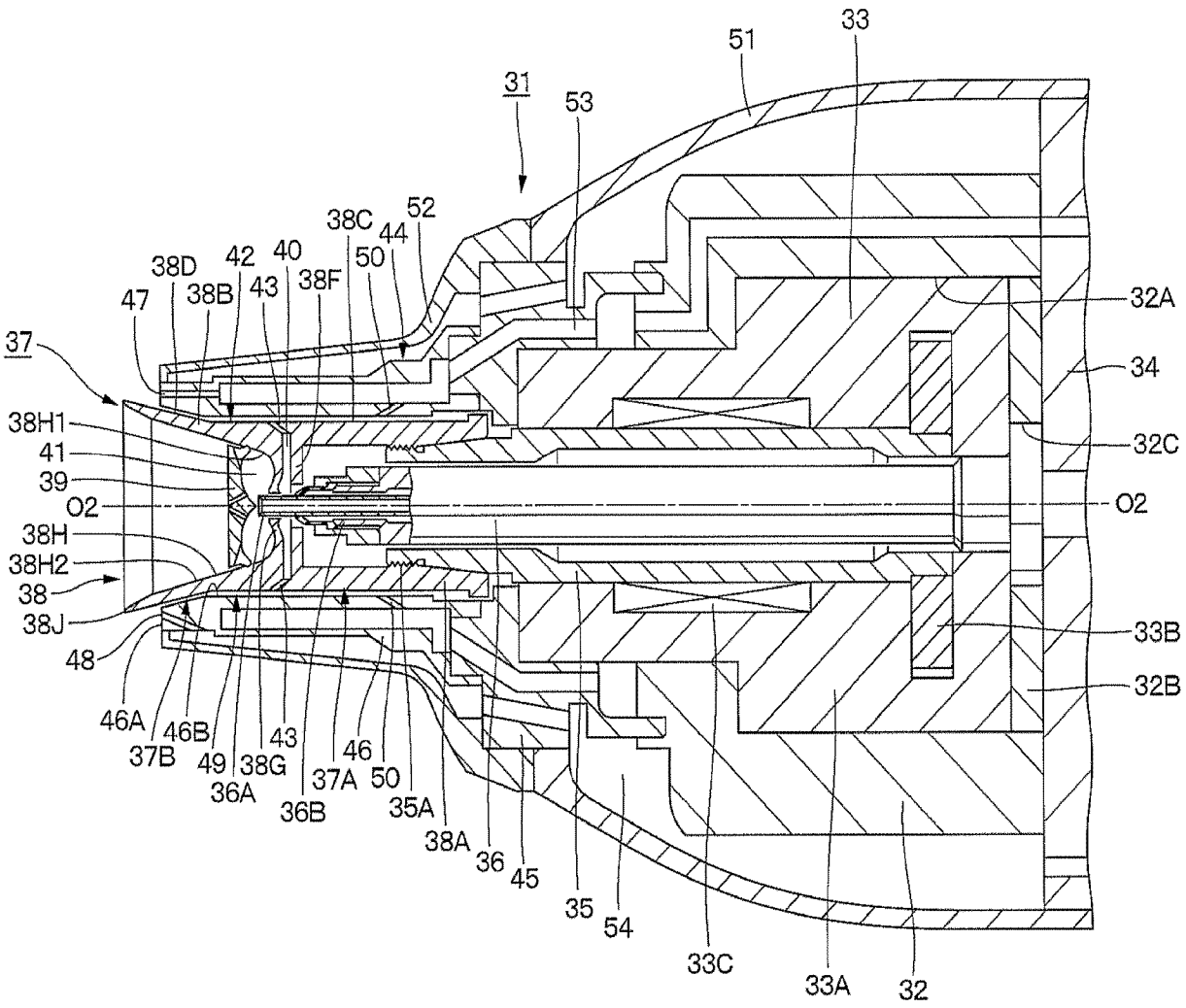
FIG. 5 is a longitudinal cross section showing a rotary atomizing head type coating machine according to a second embodiment.
Figure 6:
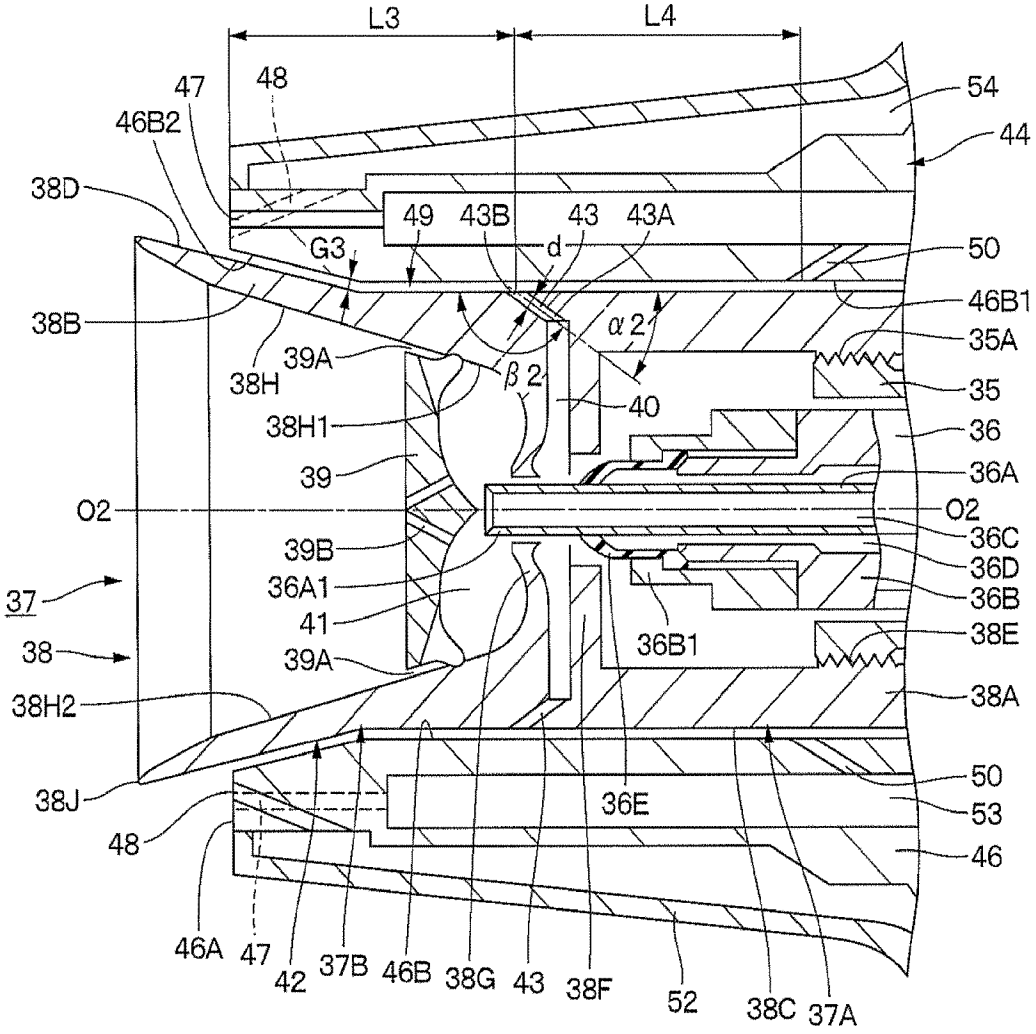
FIG. 6 is a longitudinal cross section showing a front part of the rotary atomizing head type coating machine in FIG. 5 in an enlarging manner.

Next, FIG. 5 and FIG. 6 show a second embodiment of the present invention. The second embodiment is characterized in that an atomizing head outer peripheral surface of a rotary atomizing head is formed with a cylindrical surface positioned on an outer peripheral side of a cylindrical section and a conical surface positioned on an outer peripheral side of the cup-shaped section, an outflow opening of an outer peripheral surface washing passage is made to an inclined opening open on a cylindrical surface in a state of being inclined forward to a rotational shaft, and an angle between the inclined opening and the cylindrical surface of the atomizing head outer peripheral surface is made to an acute angle.

It should be noted that the second embodiment adopts a rotary atomizing head having a diameter dimension of approximately 30 mm. Components other than the rotary atomizing head, which differ in shape, have the same functions with the functions of the components used in the first embodiment. Therefore, in the second embodiment, an explanation on components having the functions identical to those in the first embodiment will be simplified.

In FIG. 5, a rotary atomizing head type coating machine 31 according to the second embodiment is configured as a direct charging type electrostatic coating machine. The rotary atomizing head type coating machine 31 includes a housing 32, an air motor 33, a rotational shaft 35, a feed tube 36, a rotary atomizing head 37, a shaping air ring 44 and assist air spurting holes 50, which will be described later.

The housing 32 is provided therein with a motor accommodating part 32A. The motor accommodating part 32A is provided with an insertion hole 32C in a central position (position of an axis line O2-O2 of the rotational shaft 35 to be described later) of a bottom plate member 32B sealing the rear part for insertion and fit of the base end side of the feed tube 36 to be described later.

The air motor 33 is provided coaxially with the axis line O2-O2 within the motor accommodating part 32A in the housing 32. The air motor 33 rotates the rotational shaft 35 and the rotary atomizing head 37 to be described later at high speeds, and includes a motor case 33A, a turbine 33B and an air bearing 33C.

A base plate member 34 is arranged in back of the rotary atomizing head type coating machine 31. The housing 32 accommodating the air motor 33 is mounted to the base plate member 34.

The rotational shaft 35 is formed as a hollow tubular body that is rotatably supported on the air motor 33. The rotational shaft 35 is arranged in the motor case 33A to axially extend coaxially with the axis line O2-O2. As shown in FIG. 6, a male screw part 35A is formed in a front end part of the rotational shaft 35 to mount the rotary atomizing head 37.

The feed tube 36 is provided within the rotational shaft 35, and supplies paint or wash fluid toward the rotary atomizing head 37. A base end side of the feed tube 36 is inserted/fitted in the insertion hole 32C of the housing 32, and a front end side of the feed tube 36 projects from a tip end of the rotational shaft 35 and extends into the rotary atomizing head 37. The feed tube 36 is formed as a double tube by an inner tube 36A and an outer tube 36B. The inner tube 36A is provided therein with a paint supplying passage 36C through which paint or wash fluid flows, and an annular wash fluid supplying passage 36D is formed between the inner tube 36A and the outer tube 36B for flow of the wash fluid. A check valve 36E is provided in a front end section 36B1 of the outer tube 36B. The inner tube 36A is formed axially longer than the outer tube 36B, and a portion thereof projecting forward from the front end section 36B1 of the outer tube 36B constitutes a projecting section 36A1 (refer to FIG. 6).

Next, an explanation will be in detail made of the configuration of the rotary atomizing head 37 that is a characteristic part of the second embodiment.

The rotary atomizing head 37 is mounted in the tip end of the rotational shaft 35. The rotary atomizing head 37 has a base end side that is formed as a cylindrical section 37A mounted to the tip end of the rotational shaft 35. A portion of the rotary atomizing head 37 in front of the cylindrical section 37A is formed as a cup section 37B enlarged in a cup shape toward the front side. Here, a rear part of the cylindrical section 37A is formed by a mounting part 38A of the atomizing head body 38. The cup section 37B is formed by a flared part 38B in the atomizing head body 38. The rotary atomizing head 37 is rotated at high speeds to spray paint and the like. The rotary atomizing head 37 includes the atomizing head body 38, a hub member 39, and an outer peripheral surface washing passage 43, which will be described later.

As shown in FIG. 5, a base end side of the atomizing head body 38 constituting a body part of the rotary atomizing head 37 is formed as the cylindrical mounting part 38A mounted in the tip end of the rotational shaft 35 and a front side thereof is formed as the conical tubular flared part 38B enlarged toward the front side. Here, the mounting part 38A constitutes the cylindrical section 37A of the rotary atomizing head 37, and the flared part 38B constitutes the cup section 37B of the rotary atomizing head 37.

An outer peripheral side of the atomizing head body 38 constitutes an elongated cylindrical surface 38C in an elongated cylindrical shape over a rear part of the mounting part 38A from a rear part of the flared part 38B. An outer peripheral side of the flared part 38B positioned in front of the elongated cylindrical surface 38C constitutes a conical surface 38D in a conical shape enlarged toward the front side from a tip end of the elongated cylindrical surface 38C. An outflow opening 43B of the outer peripheral surface washing passage 43 opens on the elongated cylindrical surface 38C. An atomizing head outer peripheral surface 42 to be described later is formed by the elongated cylindrical surface 38C and the conical surface 38D.

On the other hand, as shown in FIG. 6, a female screw part 38E is provided in an intermediate position of the cylindrical section 37A of the rotary atomizing head 37 in the longitudinal direction, that is, in the recessed position of the mounting part 38A on the inner peripheral surface of the atomizing head body 38. Further, an inner peripheral side of the atomizing head body 38 is provided with an annular wash fluid partition wall 38F. The annular wash fluid partition wall 38F is provided to project in a radial inside in a position facing the front end section 36B1 of the outer tube 36B in the feed tube 36. An annular paint partition wall 38G projecting in a radial inside is provided in front of the wash fluid partition wall 38F and in a position surrounding the projecting section 36A1 of the inner tube 36A.

The inner peripheral side of the atomizing head body 38 constitutes a cup-shaped inner peripheral surface 38H in front of the paint partition wall 38G. The cup-shaped inner peripheral surface 38H is formed by a recessed inner peripheral surface 38H1 and a paint spreading surface 38H2. A tip end (front end) of the paint spreading surface 38H2 is provided with a releasing edge 38J.

The hub member 39 is provided on the cup-shaped inner peripheral surface 38H in front of the paint partition wall 38G of the atomizing head body 38. Many hub paint passages 39A (two only are shown) are provided in the circumferential direction on the outer peripheral side of the hub member 39 to be positioned between the recessed inner peripheral surface 38H1 and the outer peripheral side of the hub member 39. A plurality of hub wash fluid passages 39B (two only are shown) are provided in a position closer to the center of the hub member 39.

A wash fluid reservoir 40 is provided between the wash fluid partition wall 38F and the paint partition wall 38G of the atomizing head body 38. The wash fluid reservoir 40 reserves the wash fluid having flowed out from the wash fluid supplying passage 36D of the feed tube 36. An inflow opening 43A of the outer peripheral surface washing passage 43 to be described later is communicated with and opens to the wash fluid reservoir 40.

A paint reservoir 41 is provided between the paint partition wall 38G of the atomizing head body 38 and the hub member 39. The paint reservoir 41 reserves the paint flowing out from the paint supplying passage 36C of the feed tube 36.

An atomizing head outer peripheral surface 42 is formed by an outer peripheral surface of the atomizing head body 38, that is, by the elongated cylindrical surface 38C and the conical surface 38D. The atomizing head outer peripheral surface 42 is shaped to keep an annular clearance 49 formed between a ring inner peripheral surface 46B of a front ring section 46 constituting the shaping air ring 44 to be described later and the atomizing head outer peripheral surface 42 to be approximately constant with a small clearance.

Next, an explanation will be in detail made of the configuration and function of the outer peripheral surface washing passage 43 that is a characteristic part of the second embodiment.

The outer peripheral surface washing passage 43 includes a plurality of outer peripheral surface washing passages 43, for example, four passages that are provided by intervals in the circumferential direction in the cylindrical section 37A of the rotary atomizing head 37 to open onto the atomizing head outer peripheral surface 42 provided on the outer peripheral side of the atomizing head body 38. Each of the outer peripheral surface washing passages 43 causes the wash fluid supplied through the paint supplying passage 36C of the feed tube 36 to flow out to the annular clearance 49 to be described later. Therefore, each of the outer peripheral surface washing passages 43 communicates the wash fluid reservoir 40 of the atomizing head body 38 with the atomizing head outer peripheral surface 42 (annular clearance 49).

Each of the outer peripheral surface washing passages 43 is formed as a linear circular passage inclined forward from an inner diameter side of the cylindrical section 37A of the rotary atomizing head 37 to an outer diameter side thereof. Thereby, the inflow opening 43A in the inner diameter side in each of the outer peripheral surface washing passages 43 is communicated with the wash fluid reservoir 40. On the other hand, the outflow opening 43B positioned in the outer diameter side in each of the outer peripheral surface washing passages 43 opens on the elongated cylindrical surface 38C forming the atomizing head outer peripheral surface 42 and is communicated with the annular clearance 49.

Here, an explanation will be in detail made of the configuration of each of the outer peripheral surface washing passages 43. As shown in FIG. 6, the outflow opening 43B of the outer peripheral surface washing passage 43 is provided in a position closer to the rear side into the annular clearance 49 by an axial length dimension L3 than a front end surface 46A of the shaping air ring 44 to be described later. The length dimension L3 showing the rear side position of the outflow opening 43B is set according to the following formula 6.

$$1\ \text{mm} \le L3 \le 20\ \text{mm}, \qquad \text{[Formula 6]}$$

preferably, $5\ \text{mm} \le L3 \le 20\ \text{mm}$

Next, the outflow opening 43B of each of the outer peripheral surface washing passages 43 opens on the annular clearance 49 at angle $\alpha 2$ that is an acute angle to the elongated cylindrical surface 38C of the atomizing head body 38. Thereby, since the wash fluid flowing out from each of the outflow openings 43B collides at an acute angle with the ring inner peripheral surface 46B in the shaping air ring 44, the wash fluid is smoothly transmitted to the atomizing head outer peripheral surface 42 (elongated cylindrical surface 38C). It should be noted that when an angle $\alpha 2$ to a section of the elongated cylindrical surface 38C in back of each of the outer peripheral surface washing passages 43 is an acute angle, an angle $\beta 2$of the outer peripheral surface washing passage 43 to a section of the elongated cylindrical surface 38C positioned in front of the outer peripheral surface washing passage 43 becomes an obtuse angle.

In this case, it is preferable that the angle $\alpha 2$ is an angle as acute as possible, and is set as the following formula 7.

$$20° \le \alpha 2 \le 75° \qquad \text{[Formula 7]}$$

Further, the outflow opening 43B of each of the outer peripheral surface washing passages 43 is formed as a small circular hole, and the inner diameter dimension d is set to a value as the following formula 8.

$$0.3\ \text{mm} \le d \le 1.2\ \text{mm}, \qquad \text{[Formula 8]}$$

preferably, $0.4\ \text{mm} \le d \le 0.8\ \text{mm}$

In a case of washing the paint having adhered to the front section of the atomizing head outer peripheral surface 42, that is, the conical surface 38D of the atomizing head body 38 in the rotary atomizing head 37, the wash fluid is supplied from the wash fluid supplying passage 36D in the feed tube 36 while rotating the rotary atomizing head 37 at high speeds. Thereby, since the wash fluid is supplied to the conical surface 38D through the wash fluid reservoir 40, the outer peripheral surface washing passage 43 and the elongated cylindrical surface 38C, it is possible to wash the paint having adhered to the conical surface 38D by the wash fluid.

Next, an explanation will be made of the shaping air ring 44, and first and second shaping air spurting holes 47, 48.

The shaping air ring 44 is arranged on the outer peripheral side of the rotary atomizing head 37 and adjusts a spraying pattern of paint sprayed from the rotary atomizing head 37. The shaping air ring 44 includes a rear ring section 45 in a stepped cylindrical shape mounted in the air motor 33 to surround a front section of the air motor 33, the front ring section 46 in a stepped cylindrical shape mounted in a front section of the rear ring section 45 to surround the rotary atomizing head 37, and the first shaping air spurting hole 47 and the second shaping air spurting hole 48 provided in the front ring section 46.

The front end surface 46A of the front ring section 46 is arranged in a position projecting closer to the front side by the aforementioned length dimension L3 than the outflow opening 43B of the outer peripheral surface washing passage 43. The front end surface 46A is provided with the first shaping air spurting hole 47 and the second shaping air spurting hole 48.

The front ring section 46 has the ring inner peripheral surface 46B facing the atomizing head outer peripheral surface 42 of the rotary atomizing head 37 with a clearance. The ring inner peripheral surface 46B is formed over an approximately entire length other than the front section of the rotary atomizing head 37. The ring inner peripheral surface 46B is formed to face the atomizing head outer peripheral surface 42 (the elongated cylindrical surface 38C and the conical surface 38D of the atomizing head body 38) with an approximately constant clearance dimension. That is, the ring inner peripheral surface 46B is formed by a cylindrical surface part 46B1 facing the elongated cylindrical surface 38C and a cylindrical surface part 46B2 facing the conical surface 38D. In this way, the annular clearance 49 to be described later is defined between the ring inner peripheral surface 46B and the atomizing head outer peripheral surface 42.

The first shaping air spurting holes 47 are numerously provided in the circumferential direction and are connected to a first air source (not shown) through a first shaping air passage 53 to be described later.

The second shaping air spurting holes 48 are numerously provided on the front end surface 46A of the front ring section 46 to be positioned between the respective first shaping air spurting holes 47 in the circumferential direction. Each of the second shaping air spurting holes 48 is connected to a second air source (not shown) through a second shaping air passage 54 to be described later.

Next, an explanation will be made of the annular clearance 49 provided between the outer peripheral surface of the rotary atomizing head 37 and the inner peripheral surface of the shaping air ring 44 and the assist air spurting hole 50 provided in the shaping air ring 44.

The annular clearance 49 is defined between the ring inner peripheral surface 46B of the front ring section 46 constituting the shaping air ring 44 and the atomizing head outer peripheral surface 42 in the rotary atomizing head 37. The annular clearance 49 is formed as a thin space in such a manner that an axial rear side is formed in a cylindrical shape and an axial front side is formed in a conical shape (trumpet shape) enlarged toward the front side, along the ring inner peripheral surface 46B and the atomizing head outer peripheral surface 42. Here, a clearance dimension (thickness dimension of a space) G3 of the annular clearance 49 is set to a value as the following formula 9.

$$0.3\ \text{mm} \le G3 \le 1.0\ \text{mm}, \qquad \text{[Formula 9]}$$

preferably, $0.5\ \text{mm} \le G3 \le 0.8\ \text{mm}$

The assist air spurting hole 50 opens onto the cylindrical surface part 46B1 of the ring inner peripheral surface 46B constituting the front ring section 46 of the shaping air ring 44 in the intermediate position of the cylindrical section 37A of the rotary atomizing head 37 in the longitudinal direction. The assist air spurting holes 50 are composed of small holes numerously formed in the circumferential direction and open to be slightly inclined in a radial inside to the axis line O2-O2 of the rotational shaft 35 (for example, approximately 20 to 40 degrees). Each of the assist air spurting holes 50 is connected to, for example, the first shaping air passage 53.

Here, in a case of arranging each of the assist air spurting holes 50, a distance relation to the outflow opening 43B of the outer peripheral surface washing passage 43 is important, and an axial length dimension L4 is set to a value of the following formula 10 as approximately similar to the length dimension L2 according to the first embodiment.

$$13\ \text{mm} \le L4 \le 23\ \text{mm}, \qquad \text{[Formula 10]}$$

preferably, $16\ \text{mm} \le L4 \le 20\ \text{mm}$

It should be noted that as shown in FIG. 5, a rear cover 51 is provided surrounding the housing 32. A front cover 52 is provided surrounding the shaping air ring 44 in front of the rear cover 51.

The first shaping air passage 53 supplies compressed air from the first air source to each of the first shaping air spurting holes 47. The second shaping air passage 54 supplies compressed air from the second air source to each of the second shaping air spurting holes 48.

The rotary atomizing head type coating machine 1 according to the second embodiment has the configuration as described above, and next, an explanation will be made of a case of washing the paint having adhered to the front section (conical surface 38D) of the atomizing head outer peripheral surface 42 in the rotary atomizing head 37.

First, the wash fluid flows out from the wash fluid supplying passage 36D of the feed tube 36 to the wash fluid reservoir 40 while rotating the rotary atomizing head 37 at high speeds. The wash fluid reserved in the wash fluid reservoir 40 flows out into the annular clearance 49 through the outer peripheral surface washing passage 43 by centrifugal forces. On the other hand, the assist air spurting holes 50 supply assist air into the annular clearance 49. Thereby, the assist air can smoothly guide the wash fluid flowing out into the annular clearance 49 from the outer peripheral surface washing passage 43 toward the conical surface 38D of the atomizing head body 38. As a result, it is possible to effectively wash the paint having adhered to the conical surface 38D.

In this way, also in the second embodiment as thus configured, it is possible to obtain an operational effect as approximately similar to the first embodiment as mentioned before. Particularly, according to the second embodiment, the atomizing head outer peripheral surface 42 of the atomizing head body 38 is formed with the elongated cylindrical surface 38C and the conical surface 38D. In this case, the outflow opening 43B of the outer peripheral surface washing passage 43 constitutes the inclined opening inclined forward to the rotational shaft 35. Thereby, the outflow opening 43B of the outer peripheral surface washing passage 43 makes the angle α2 between the outflow opening 43B and the elongated cylindrical surface 38C the acute angle. Accordingly, the wash fluid flowing out from the outflow opening 43B that is the inclined opening of the outer peripheral surface washing passage 43 can be caused to smoothly flow on the elongated cylindrical surface 38C and the conical surface 38D to certainly wash the paint having adhered to the conical surface 38D for a short time.

Figure 7:
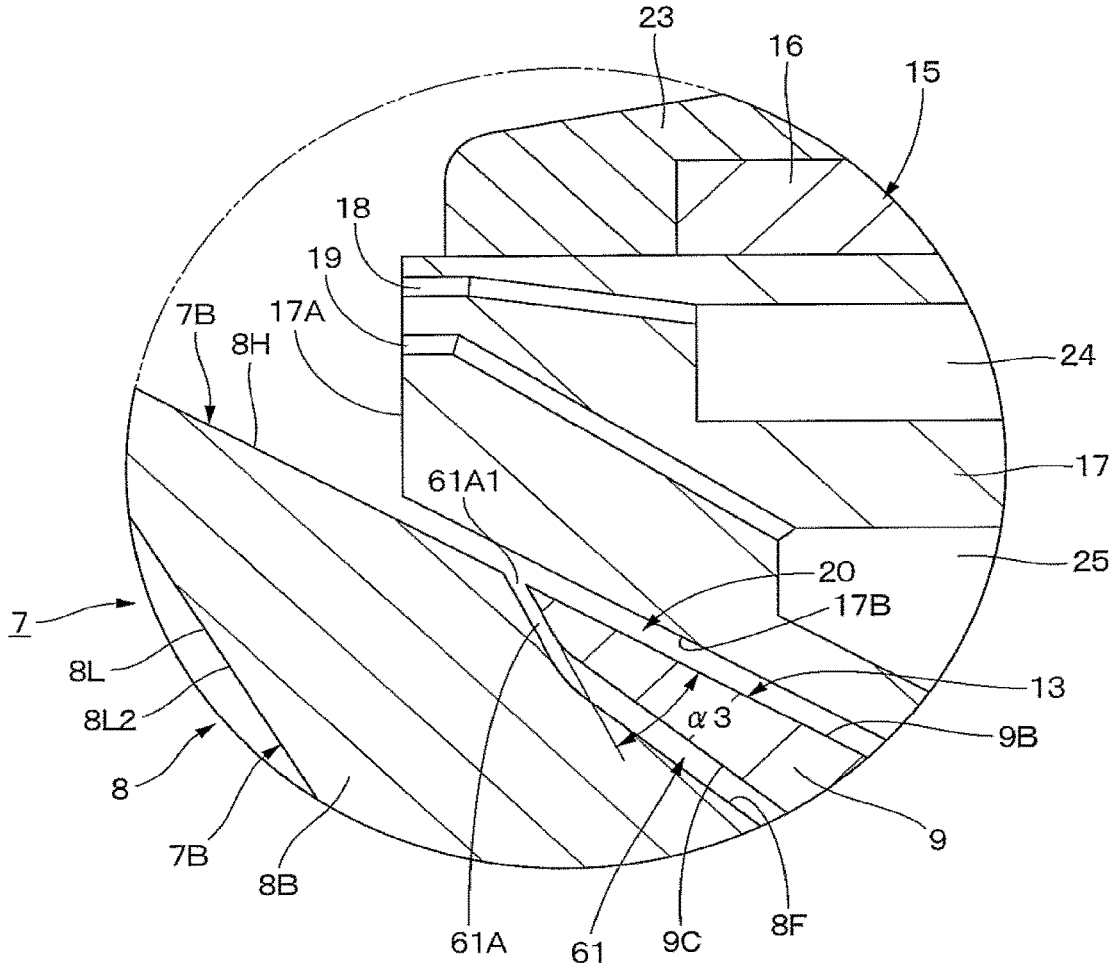
FIG. 7 is a partially enlarged longitudinal cross section showing a rotary atomizing head type coating machine provided with an outer peripheral surface washing passage according to a modification as viewed in a position as similar to FIG. 3.

It should be noted that the first embodiment is explained by taking a case where the outflow opening 14C1 of the outflow passage 14C constituting the outer peripheral surface washing passage 14 is provided to be perpendicular to the axis line O1-O1 of the rotational shaft 5 and is made to open in the radial outward to the atomizing head outer peripheral surface 13, as the example. However, the present invention is not limited thereto, but may be configured as a modification shown in FIG. 7, for example. That is, an outer peripheral surface washing passage 61 according to the modification shown in FIG. 7 is configured to open in the radial outward to the atomizing head outer peripheral surface 13 in a state of inclining an outflow opening 61A1 of an outflow passage 61A thereof forward from an inner diameter side to an outer diameter side. With this configuration, an angle α3 between the outflow opening 61A1 of the outflow passage 61A and the atomizing head outer peripheral surface 13 can be made to a smaller acute angle.

The first embodiment is explained by taking a case of connecting each of the assist air spurting holes 21 to the first shaping air passage 24, as an example. However, the present invention is not limited thereto, but each of the assist air spurting holes 21 may be connected to the second shaping air passage 25. Further, each of the assist air spurting holes 21 may be connected to an independent air passage independent from each of the shaping air passages 24, 25. These configurations may be likewise applied to the second embodiment.

The first embodiment is explained by taking the direct charging type electrostatic coating machine that directly applies high voltages to the paint supplied to the rotary atomizing head 7 as an example of the rotary atomizing head type coating machine 1. However, the present invention is not limited thereto, but may be applied to, for example, an indirect charging type electrostatic coating machine that has an external electrode to discharge high voltages on an outer peripheral position of the rotary atomizing head 7 and applies the high voltage to paint particles sprayed from the rotary atomizing head 7 by the discharge from the external electrode. Further, the present invention may be applied to a non-electrostatic coating machine that performs coating without applying high voltages to paint. The configuration may be likewise applied to the second embodiment.

DESCRIPTION OF REFERENCE NUMERALS

1, 31: Rotary atomizing head type coating machine
3, 33: Air motor
5, 35: Rotational shaft
6, 36: Feed tube
6A, 36A: Inner tube
6A1, 36A1: Projecting section
6B, 36B: Outer tube
6B1, 36B1: Front end section
6E, 36E: Check valve
7, 73: Rotary atomizing head
7A, 37A: Cylindrical section
7B, 37B: Cup section
8, 38: Atomizing head body
8A, 38A: Mounting part
8B, 38B: Flared part
8C: Cylindrical surface
8H: Front outer peripheral surface (Conical surface)
8J, 38F: Wash fluid partition wall
8K, 38G: Paint partition wall
8L, 38H: Cup-shaped inner peripheral surface
9: Annular cover
9B: Rear outer peripheral surface (Conical surface)
10, 39: Hub member
10A, 39A: Hub paint passage
11, 40: Wash fluid reservoir
12, 41: Paint reservoir
13, 42: Atomizing head outer peripheral surface
14, 43, 61: Outer peripheral surface washing passage
14A: Radial passage
14A1, 43A: Inflow passage
14C, 61A: Outflow passage
14C1, 43B, 61A1: Outflow opening
15, 44: Shaping air ring
17, 46: Front ring section
17A, 46A: Front end surface
17B, 46B: Ring inner peripheral surface
18, 47: First shaping air spurting hole
19, 48: Second shaping air spurting hole
20, 49: Annular clearance
38C: Elongated cylindrical surface
38D: Conical surface
21, 50: Assist air spurting hole
O1-O1, O2-O2: Axis line of a rotational shaft
L1, L3: Axial length dimension of an outflow opening in an outer peripheral surface washing passage to a tip end of a shaping air ring
G2, G3: Clearance dimension of an annular clearance
α1, α2, α3: Angle of an outflow opening of an outer peripheral surface washing passage to an atomizing head outer peripheral surface of a rotary atomizing head.

The invention claimed is:

1. A rotary atomizing head type coating machine comprising:

an air motor that uses compressed air as a power source;

a hollow rotational shaft that is rotatably supported by said air motor and a tip end of which projects to a front side from said air motor;

a feed tube that extends to the tip end of said rotational shaft through in said rotational shaft and includes a paint supplying passage which supplies paint or wash fluid and a wash fluid supplying passage which supplies wash fluid;

a rotary atomizing head, a base end side of which is formed of a cylindrical section mounted to the tip end of said rotational shaft and a portion closer to a front side than said cylindrical section of which is formed of a cup section enlarged in a cup shape to spray paint from a releasing edge of said cup section;

a shaping air ring that is arranged on an outer peripheral side of said rotary atomizing head, has a ring inner peripheral surface facing an atomizing head outer peripheral surface of said rotary atomizing head with an annular clearance, and has many shaping air spurting holes on a front end surface to spurt shaping air; and an assist air spurting hole that is provided to open to said ring inner peripheral surface of said shaping air ring and spurts assist air into said annular clearance defined between said ring inner peripheral surface and said atomizing head outer peripheral surface of said rotary atomizing head, wherein said annular clearance is located at an outer part of said rotary atomizing head and is formed as a conical thin space enlarged from a rear side toward the front side thereof, along said ring inner peripheral surface and said atomizing head outer peripheral surface, said rotary atomizing head is provided with an outer peripheral surface washing passage open onto said atomizing head outer peripheral surface for causing said wash fluid supplied from said wash fluid supplying passage of said feed tube to flow out into said annular clearance, an outflow opening of said outer peripheral surface washing passage is provided in a position closer to the backside into said annular clearance than a tip end of said shaping air ring and opens into said annular clearance in an angle that is an acute angle to said atomizing head outer peripheral surface of said rotary atomizing head, and said assist air spurting hole opens into said annular clearance at a location closer to the rear side than said outflow opening of said outer peripheral surface washing passage.

2. The rotary atomizing head type coating machine according to claim 1, wherein said feed tube is formed as a double tube by an inner tube that is positioned in an axis center and through which said paint or wash fluid flows and an outer tube that is positioned on an outer peripheral side of said inner tube for flow of wash fluid between the inner tube and said outer tube, and an inflow opening of said outer peripheral surface washing passage opens in the vicinity of a front end section of said outer tube in said feed tube.

3. The rotary atomizing head type coating machine according to claim 1, wherein said atomizing head outer peripheral surface of said rotary atomizing head holds said annular clearance between said ring inner peripheral surface of said shaping air ring and said atomizing head outer peripheral surface to be approximately constant with a small clearance dimension.

4. The rotary atomizing head type coating machine according to claim 1, wherein said feed tube is formed as a double tube by an inner tube that is positioned in an axis center and through which said paint or wash fluid flows and an outer tube that is positioned on an outer peripheral side of said inner tube and opens in a position closer to the backside than a tip end of said inner tube for flow of wash fluid between the inner tube and said outer tube, said rotary atomizing head includes:

an annular wash fluid partition wall projecting in a radial inside in a position facing a front end section of said outer tube in said feed tube;

an annular paint partition wall projecting in a radial inside in front of said wash fluid partition wall and in a position of surrounding a projecting section of said inner tube; and a hub member positioned on a cup-shaped inner peripheral surface of said cup section in front of said paint partition wall and having a hub paint passage on an outer peripheral side through which paint flows out, a wash fluid reservoir provided between said wash fluid partition wall and said paint partition wall for reserving the wash fluid supplied from said outer tube of said feed tube, and a paint reservoir provided between said paint partition wall and said hub member for reserving the paint supplied from said inner tube of said feed tube, wherein an inflow opening of said outer peripheral surface washing passage opens to said wash fluid reservoir of said rotary atomizing head.

5. The rotary atomizing head type coating machine according to claim 1, wherein said atomizing head outer peripheral surface of said rotary atomizing head is formed with a cylindrical surface positioned on an outer peripheral side of said cylindrical section and a conical surface positioned on an outer peripheral side of said cup section, wherein an inflow opening of said outer peripheral surface washing passage is provided to be perpendicular to an axis line of said rotational shaft and opens in a radial inward, said outflow opening of said outer peripheral surface washing passage is positioned in said conical surface to be perpendicular to an axis line of said rotational shaft and opens in a radial outward, and an angle between said outflow opening and said conical surface of said atomizing head outer peripheral surface is an acute angle.

6. The rotary atomizing head type coating machine according to claim 1, wherein said atomizing head outer peripheral surface of said rotary atomizing head is formed with an elongated cylindrical surface positioned on an outer peripheral side of said cylindrical section and a conical surface positioned on an outer peripheral side of said cup section, an outflow opening of said outer peripheral surface washing passage constitutes an inclined opening to open on said elongated cylindrical surface in a state of being inclined forward to said rotational shaft, and an angle between said outflow opening and said elongated cylindrical surface of said atomizing head outer peripheral surface is an acute angle.

* * * * *